US006742225B2

(12) United States Patent
Marty et al.

(10) Patent No.: US 6,742,225 B2
(45) Date of Patent: Jun. 1, 2004

(54) CONNECT-RELEASE ZIPPING SYSTEM

(75) Inventors: Justin Douglas Marty, Salt Lake City, UT (US); Joseph Edward Marty, North Salt Lake, UT (US)

(73) Assignee: Z Gear, Inc., Salt Lake City, UT (US)

( * ) Notice: Subject to any disclaimer, the term of this patent is extended or adjusted under 35 U.S.C. 154(b) by 0 days.

(21) Appl. No.: 10/251,177

(22) Filed: Sep. 20, 2002

(65) Prior Publication Data

US 2004/0055117 A1 Mar. 25, 2004

(51) Int. Cl.[7] ..... A44B 19/00; A47B 9/08
(52) U.S. Cl. ..... 24/382; 5/413 R
(58) Field of Search ..... 24/382, 429, 431; 2/69.5, 234; 5/413 R

(56) References Cited

U.S. PATENT DOCUMENTS 2,178,885 A * 11/1939 Buff et al. ..... 24/382
2,622,248 A 12/1952 Schaye
2,889,605 A 6/1959 Morin
3,219,084 A * 11/1965 Ausnit
3,448,463 A 6/1969 Milone
3,726,329 A 4/1973 Dean
4,112,556 A 9/1978 Flaum et al.
4,485,534 A 12/1984 Pilié et al.
4,492,006 A 1/1985 Ishii
5,031,944 A 7/1991 Keyaki
5,490,294 A * 2/1996 Kramer ..... 5/413 R
5,697,130 A 12/1997 Smith
6,047,404 A 4/2000 Blanks, I
6,223,349 B1 5/2001 Roiser

* cited by examiner

*Primary Examiner*—Robert J. Sandy
(74) *Attorney, Agent, or Firm*—Kirton & McConkie

(57) ABSTRACT

A connect-release zipping system basically comprising four zipper tracks, four zipper sliders on the zipper tracks, and a central connector to which the zipper sliders are affixed. The zipper sliders are fixed to the central connector in such a way that when one of the zipper sliders moves along its respective zipper track, all of the other zipper sliders simultaneously move along their respective zipper tracks. This simultaneous movement causes two zipper tracks to zip together, and two zipper tracks to unzip. The connect-release zipping system may be incorporated into a sleeping bag to allow the bag to easily transform into a jumpsuit.

20 Claims, 7 Drawing Sheets

CONNECT-RELEASE ZIPPING SYSTEM

BACKGROUND

1. Field of the Invention

The present invention relates generally to methods and systems for transforming, via a zipping mechanism, a compartment of material or fabric into varied shapes or compartments. More particularly, the present invention relates to a multi-zippered device that, with a single pushing or pulling motion, connects two sides of material while simultaneously disconnecting two other sides of material.

2. Background

Several types of multi-zippered devices have been designed for various uses. One multi-zippered device has three rows of zipper teeth, one row of which is shared by two opposing zipper sliders at opposite ends of the shared row of teeth. This device is used to vary the size of, for example, a laundry bag. Another device has two parallel zippers such that one is placed on top of the other. This device is designed to allow, for example, a piece of clothing to vary between two sizes to accommodate weight gain or loss by the person who wears the clothing. Another device has a central interchange through which the ends of a pair of zipper teeth are inserted and through which each row of teeth are thereby interchanged and mated with another pair of zipper teeth. This device inconveniences the user because it requires him or her to manually align and insert the end of a row of zipper teeth into a holed piece in order to connect that row to a new row of zipper teeth.

As can be seen from the examples above, known multi-zippered devices either have limited functionality and/or are complicated and unwieldy to use, thus contributing to their limited commercial success. Hence, a simple-to-use compartmentalizing zipper device would be enthusiastically welcomed and find significant appeal to a wide variety of commercial markets.

SUMMARY AND OBJECTS OF THE INVENTION

The present invention basically comprises a connect-release zipping system having multiple zipper tracks (preferably four), a zipper slider on each of the zipper tracks, and a central connector to which the zipper sliders are affixed. The zipper sliders are fixed to the central connector in such a way that when one of the zipper sliders moves along its respective zipper track, all of the other zipper sliders simultaneously move along their respective zipper tracks. This simultaneous movement causes some zipper tracks to zip together, and some zipper tracks to unzip. The connect-release zipping system may be incorporated into a sleeping bag to allow the bag to easily transform into a jumpsuit.

Accordingly, it is an object of some embodiments of the present invention to provide a simple-to-use device that compartmentalizes material into varying shapes or compartments.

Another object of some embodiments of the present invention is to provide a multi-zippered compartmentalizing device that accomplishes simultaneous zipping and unzipping with a single push or pull of a handle.

Another object of some embodiments of the present invention is to provide a multi-zippered compartmentalizing system wherein a central connector holds multiple zipper sliders in a ring-like formation so that the sliders can be moved along their respective zipper tracks simultaneously.

Yet another object of some embodiments of the present invention is to provide a simple multi-zipper system that transforms a sleeping bag into a jumpsuit without requiring the occupant to exit the sleeping bag.

A further object of some embodiments of the present invention is to provide a method for connecting two edges of material while simultaneously releasing two other edges of material using a series of alternating zippers whose sliders are fixed together by a central connector.

Another object of some embodiments of the present invention is to provide a series of zipper tracks wherein zipper sliders for each track surround and are connected to a central connector having a central handle for pushing or pulling the group of zipper sliders.

BRIEF DESCRIPTION OF THE DRAWINGS

The foregoing and other objects and features of the present invention will become more fully apparent from the accompanying drawings when considered in conjunction with the following description and appended claims. Other objects will likewise become apparent from the practice of the invention as set forth hereafter. Although the drawings depict only typical embodiments of the invention and are thus not to be deemed limiting of the invention's scope, the accompanying drawings help explain the invention in added detail.

DETAILED DESCRIPTION OF EMBODIMENTS OF THE PRESENT INVENTION

The following detailed description, in conjunction with the accompanying drawings (hereby expressly incorporated as part of this detailed description), sets forth specific numbers, materials, and configurations in order to provide a thorough understanding of the present invention. The following detailed description, in conjunction with the drawings, will enable one skilled in the relevant art to make and use the present invention.

The purpose of this detailed description being to describe the invention so as to enable one skilled in the art to make and use the present invention, the following description sets forth various specific examples, also referred to as "embodiments," of the present invention. While the invention is described in conjunction with specific embodiments, it will be understood, because the embodiments are set forth for explanatory purposes only, that this description is not intended to limit the invention to these particular embodiments. Indeed, it is emphasized that the present invention can be embodied or performed in a variety of ways. The drawings and detailed description are merely representative of particular embodiments of the present invention.

Reference will now be made in detail to several embodiments of the invention. The various embodiments will be described in conjunction with the accompanying drawings wherein like elements are designated by like alphanumeric characters throughout.

Figure 1:
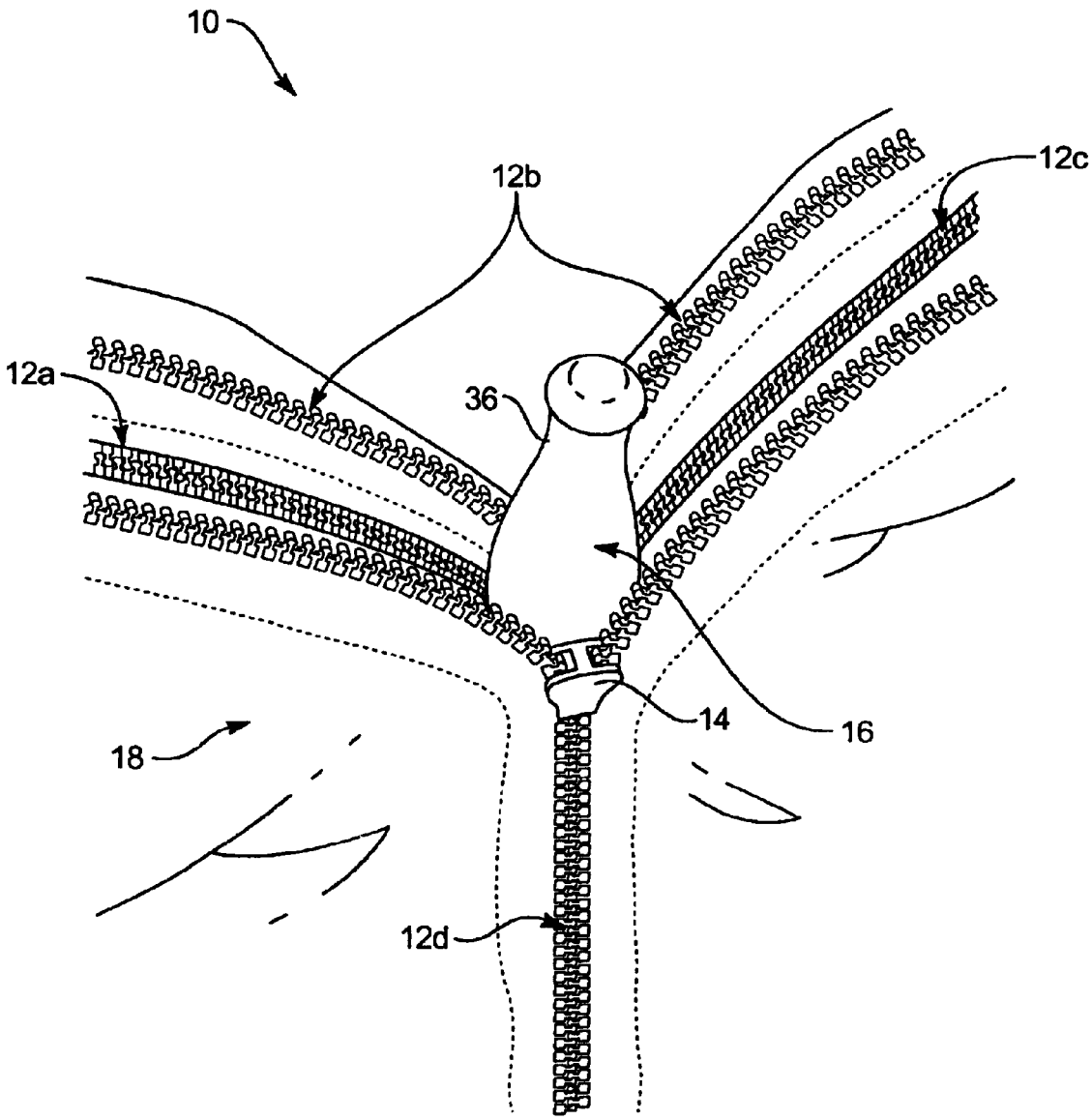
FIG. 1 shows one embodiment of the connect-release zipping device having four zipper tracks, the zipping device causing two opposing tracks to be zipped while simultaneously causing the other two opposing tracks to be unzipped.

FIG. 1 is a perspective view of a connect-release zipping device or quad zipper 10 according to one embodiment of the present invention. Quad zipper 10 basically comprises four individual zipper tracks, 12*a*, 12*b*, 12*c*, and 12*d* (collectively "12*a*–12*d*"), a zipper slider 14 on each of the tracks 12*a*–12*d* for zipping each of the tracks 12*a*–12*d*, and a central connector 16 for centrally connecting each of the zipper sliders 14. The quad zipper 10 is attached or sewn to material 18 so that when the central connector 16 is pulled, two opposing zipper tracks 12*a* and 12*c* (notice that each track comprises two rows of zipper teeth) unzip, and, simultaneously, the two other opposing zipper tracks 12*b* and 12*d* zip together. If the central connector 16 is pushed in the opposite direction, the tracks that zipped together now unzip, and the tracks that unzipped now zip together. This connect-release function of the quad zipper 10 can be used in a variety of ways to conveniently and efficiently transform the material 18 into different forms or volumes for alternate uses.

Figure 2:
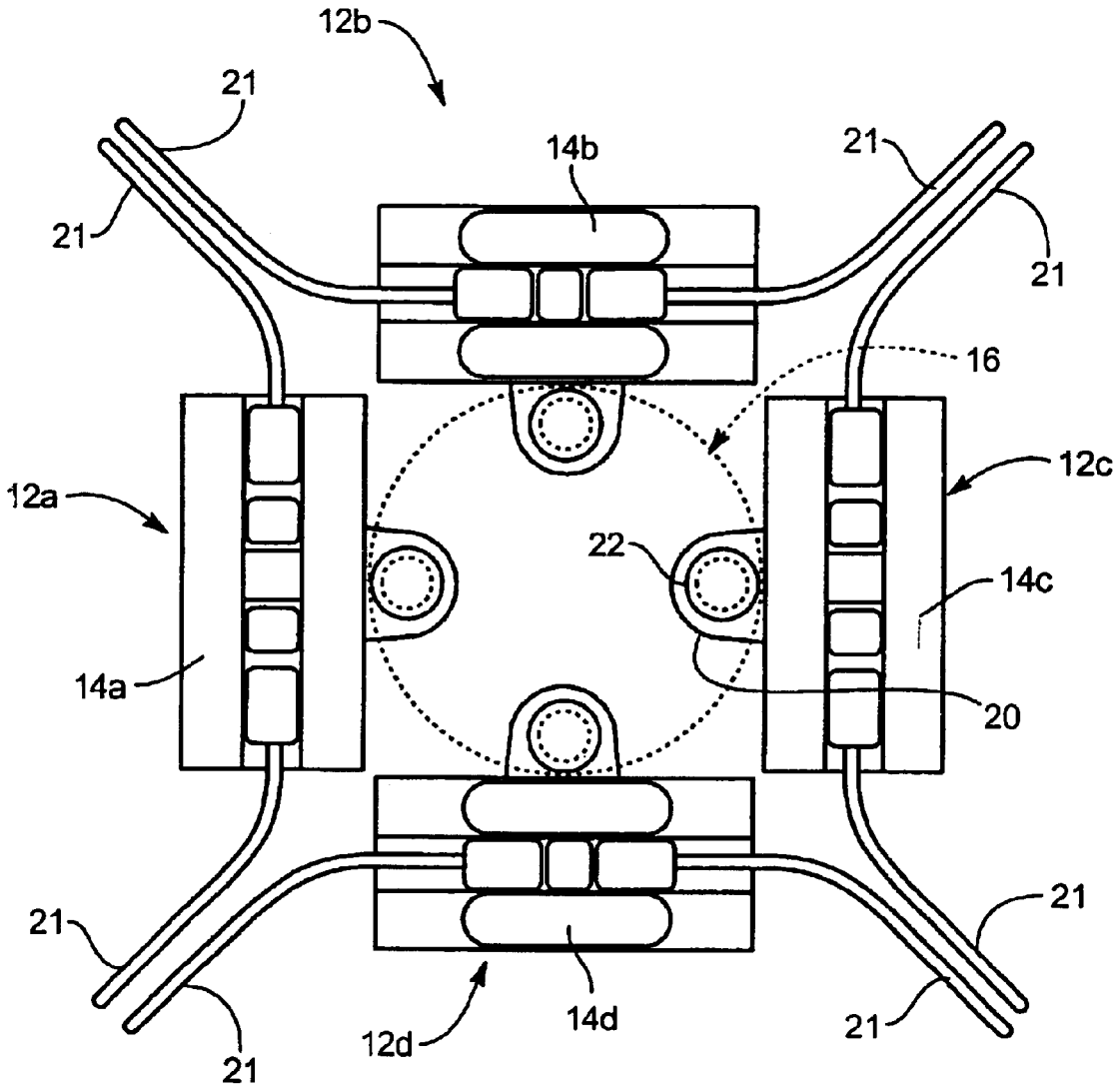
FIG. 2 is a cross sectional plan view of one embodiment of a connect-release zipping device showing four alternating zipper sliders connected in a ring-like formation.

FIG. 2 shows a cross sectional plan view of the quad zipper 10. Shown are four zipper sliders 14*a*, 14*b*, 14*c*, and 14*d* (collectively "14*a*–14*d*") for zipping and unzipping along their respective tracks 12*a*, 12*b*, 12*c*,and 12*d*. In the preferred embodiments of the present invention, adjacent zipper sliders 14*a*–14*d* are oriented in alternating orientations. For example, FIG. 2 shows sliders 14*a* and 14*c* to be facing in one direction, and sliders 14*b* and 14*d* facing in the opposite direction. This alternating orientation of the sliders 14*a*–14*d* causes two of the tracks 12 to zip together and two of the tracks 12 to simultaneously unzip when the quad zipper is either pushed or pulled.

Figure 3A:
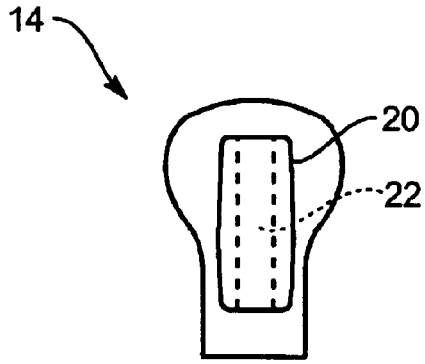
FIGS. 3A through 3C show various views of one embodiment of a zipper slider of the present invention, FIG. 3A being an elevational view of the front of the zipper slider, FIG. 3B a side elevational view of the zipper slider, and FIG. 3C being a top plan view of the zipper slider embodiment.
Figure 3B:
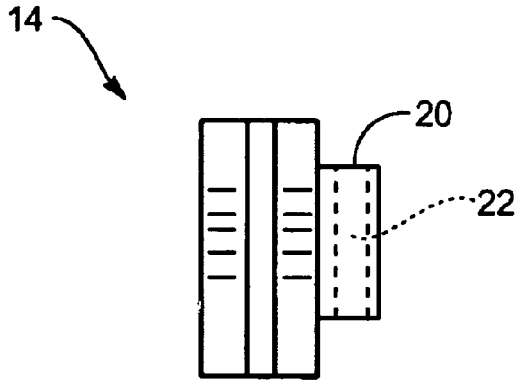
Figure 3C:
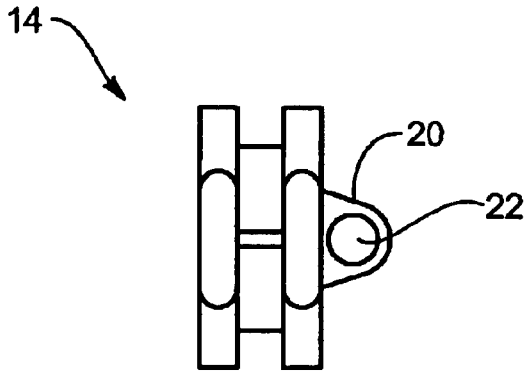
Figure 4A:
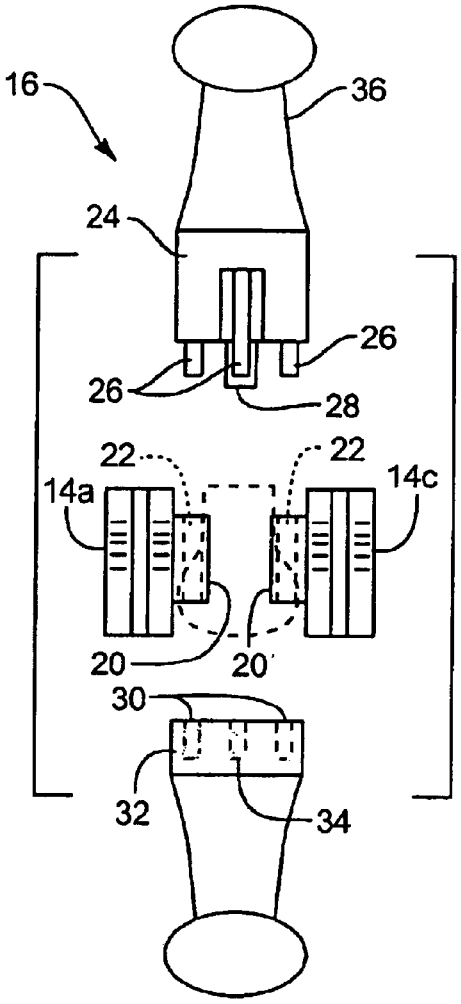
FIG. 4A is an exploded elevational view showing how the handle and the zipper sliders are connected according to one embodiment of the present invention.
Figure 4B:
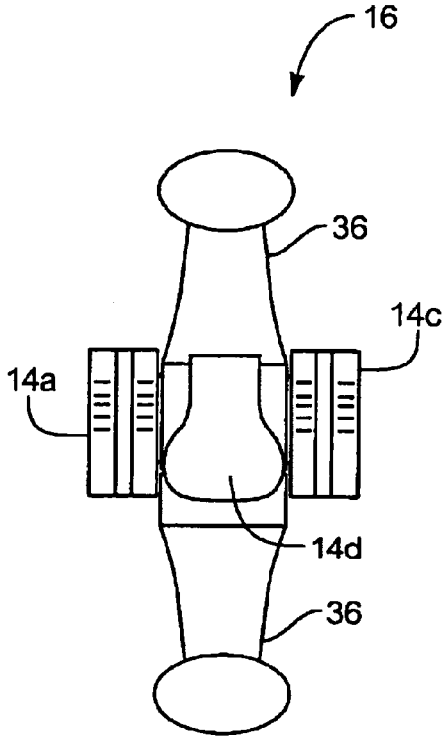
FIG. 4B shows the parts in FIG. 4A when connected together.
Figure 5A:
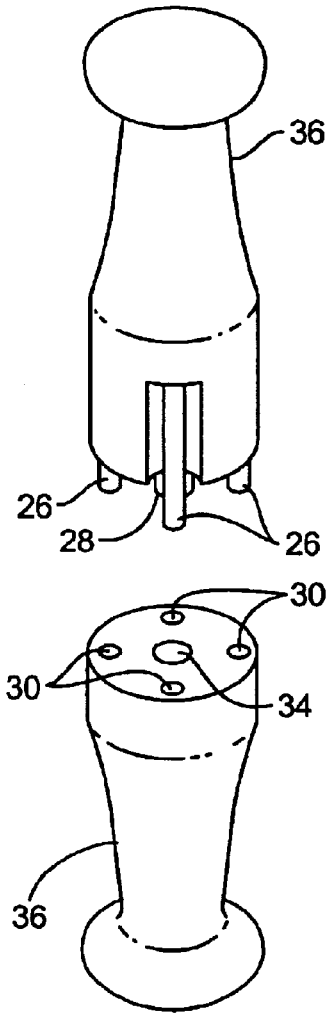
FIG. 5A is a perspective view of the central connector shown in FIGS. 4A and 4B.
Figure 5B:
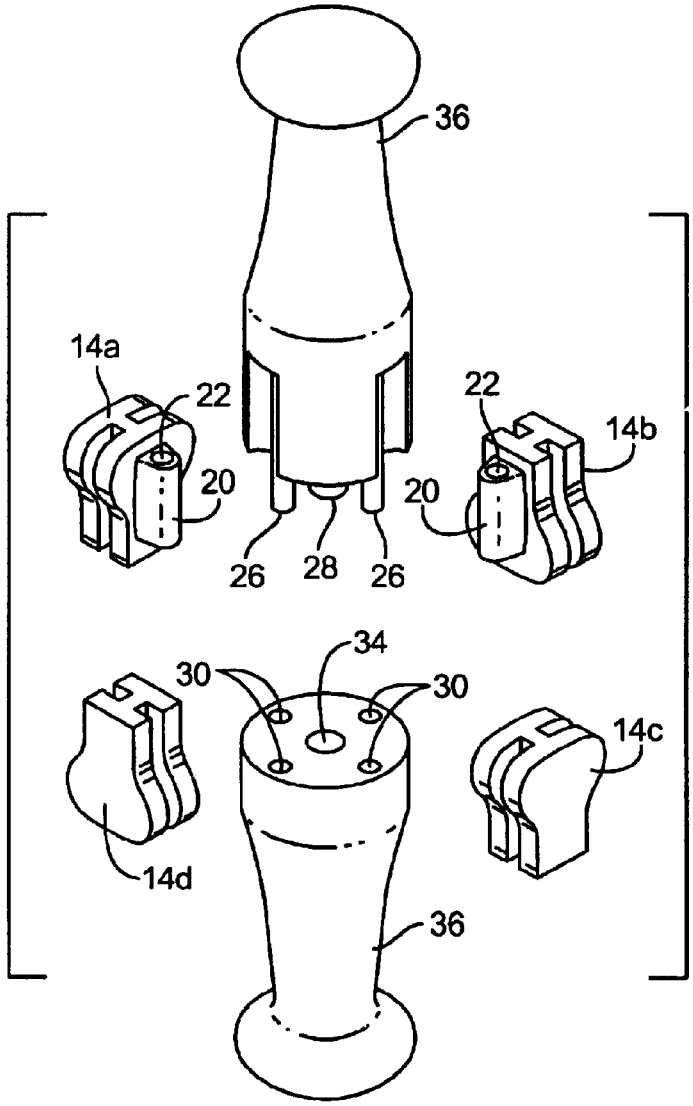
FIG. 5B is an exploded perspective view of the embodiment shown in FIG. 4A.

FIG. 2 also shows a cross section of the central connector 16 to which the zipper sliders 14*a*–14*d* are connected. The zipper sliders of the present invention may be connected to the central connector 16 in any appropriate way. In this embodiment, the zipper sliders 14*a*–14*d* each have an extension 20 (commonly known in the zipper industry as a "nose piece") by which the sliders 14*a*–14*d* are connected to the central connector 16. Note that extension 20 has a hole 22 (shown in dotted lines in FIGS. 3A and 3B). As can be seen in the various views of the slider 14 in FIGS. 3A, 3B, and 3C, this particular extension 20 is specially molded because the hole 22 is a longitudinally oriented hollow instead of a horizontally oriented hollow. However, it may instead be more financially beneficial to produce the quad zipper 10 using pre-existing moulds for zipper sliders.

In the preferred embodiments of the present invention, the zipper sliders 14*a*–14*d* are oriented in a ring-like formation, as shown in FIG. 2. Moreover, each zipper track 12*a*–12*d* has edges 21 that are attached or sewn to the edges 21 of the adjacent zipper track. As such, the orientation of the sliders 14*a*–14*d* causes two opposing tracks 12*a* and 12*c* to zip together and the other two opposing tracks 12*b* and 12*d* to simultaneously unzip when the central connector 16 is either pushed or pulled.

As shown in FIGS. 4A through 5B, one embodiment of the central connector 16 may comprise a male piece 24 and a female piece 32 wherein the male piece 24 has peripheral extensions 26 that, during the assembly process, are inserted into the holes 22 of the zipper slider extensions 20. The peripheral extensions 26 are then inserted into complementary peripheral receiving holes 30 in the female piece 32. A central extension 28 on the male piece 24 is also received by a central receiving hole 34 in the female piece 32. The central extension 28 and/or the peripheral extensions 26 are secured into their respective holes 34, and 30 so that the male piece 24 and the female piece 32 are securely attached, thereby ensuring a reliable connection between the zipper sliders 14*a*–14*d* and the central connector 16. In some embodiments, the central extension 28 and/or the peripheral extensions 26 have a flange around the tip (not shown), which allows the male piece 24 to snap into the female piece 32.

The central connector 16 also comprises a handle 36 (various examples of which are shown in FIG. 1 and FIGS. 4A through 6B) whereby the central connector 16 can be pushed or pulled. The handle 36 can be shaped in any suitable manner that allows a person to either push the handle 36 downward, thereby sliding the central connector 16 downward along the zipper tracks 12*a*–12*d*, or pull the handle 36 upward, thereby sliding the central connector 16 upward along the zipper tracks 12*a*–12*d*. The handle 36 may be a separate piece attached to the central connector 16 or may be integrally formed with the connector 16. The central connector 16 may include any number of handles 36.

In the embodiment shown in FIGS. 4A through 5B, two handles 36 (the handles shown here each being shaped similarly to a milk bottle) are available to manipulate the central connector 16. When incorporated into clothing, for example, this embodiment might have one handle 36 extending into the interior of the clothing, and one handle 36 extending exteriorially from the clothing. Thus, the wearer/user is able to move the central connector 16 from within the interior of the clothing (via the interior handle); the wearer/user may also move the central connector 16 from a point exterior to the clothing (via the exterior handle). FIG. 1 might serve to illustrate such an embodiment when incorporated into clothing. Note that, in FIG. 1, only the exterior handle 36 is visible.

Figure 6A:
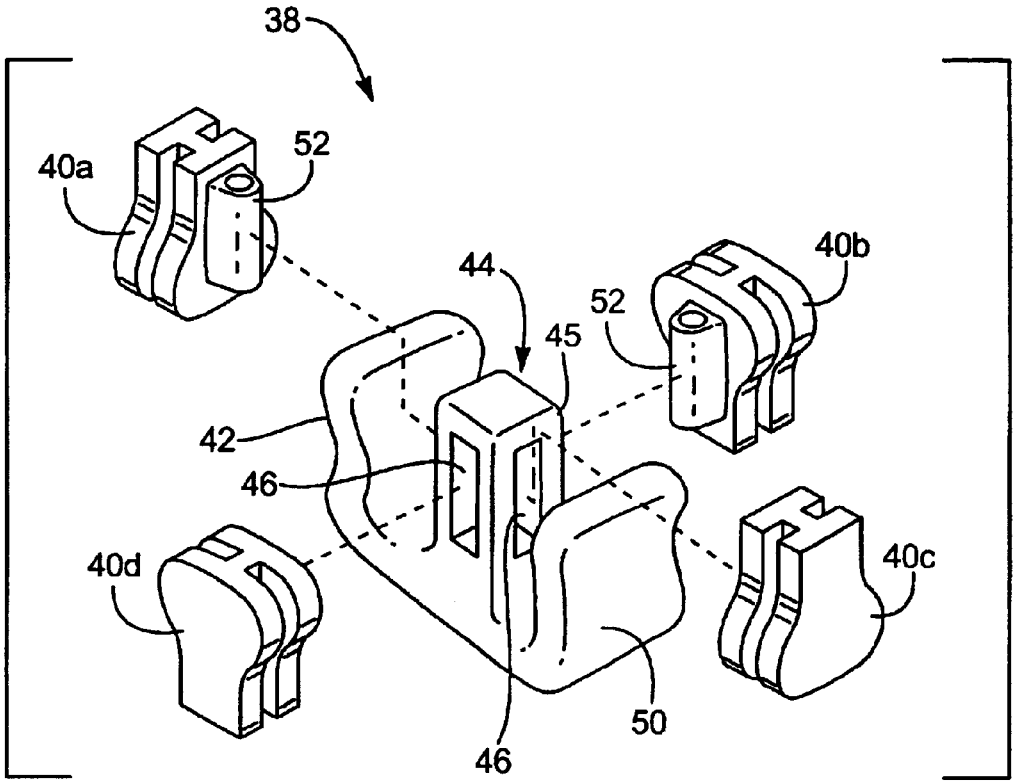
FIG. 6A is an exploded perspective view showing one embodiment of the zipper sliders and the central connector.
Figure 6B:
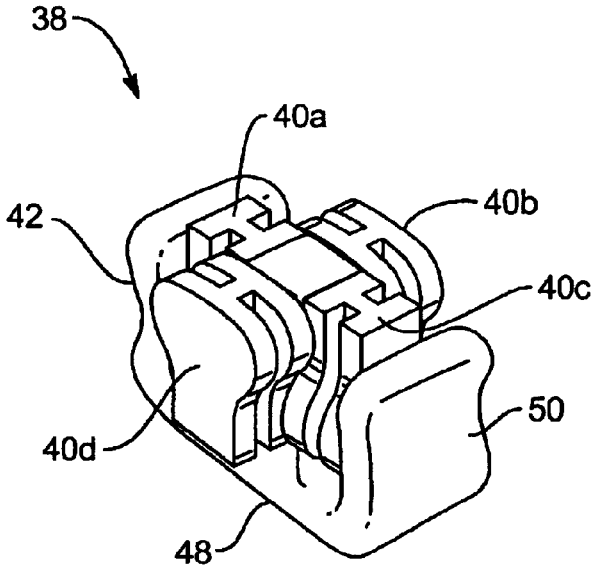
FIG. 6B is a perspective view of the embodiment shown in FIG. 7A.

FIGS. 6A and 6B illustrate another example of the present invention. In this embodiment, a central connector 38 is integrally formed with zipper sliders 40*a*, 40*b*, 40*c*, and 40*d* (collectively "40*a*–40*d*"), preferably using the process of insert molding. Here, the central connector 38 includes a central piece 44 that holds the zipper sliders 40*a*–40*d*. The central piece 44 and the zipper sliders 40*a*–40*d* can be any shape; this particular central piece 44 has a center post 45, a first side 42, a second side 50, and a bottom surface 48. The center post 45 further includes slots 46 for receiving extensions 52 on the sliders 40*a*–40*d*. To create this central connector 38, the sliders 40*a*–40*d* are placed within a mould, and plastic is then shot around the slider extensions 52 to create the plastic central piece 44, the result being an integrally formed central connector 38 comprising the central piece 44 and the sliders 40*a*–40*d*. In this embodiment, the central piece 44 is plastic, and the sliders 40*a*–40*d* are metal. The just-described process is called insert molding.

It will be noted that the embodiment in FIGS. 6A and 6B has a handle that is formed integrally with the central connector 38. This handle is comprised of sides 42 and 50 and/or the bottom surface 48. The handle of this embodiment is designed to be incorporated in material 18 so that the sides 42 and 50 and bottom surface 48 are exteriorly located with respect to any volume enclosed by the material 18. In other words, if this handle were substituted for the handle 36 in FIG. 1, the bottom surface 48 is what would be visible in the figure. In order to move the central connector 38, a user can grasp the handle of FIGS. 6A and 6B at sides 42 and 50 with a thumb and forefinger. The user can also push against the bottom surface 48 to move the central connector 38.

Figure 7A:
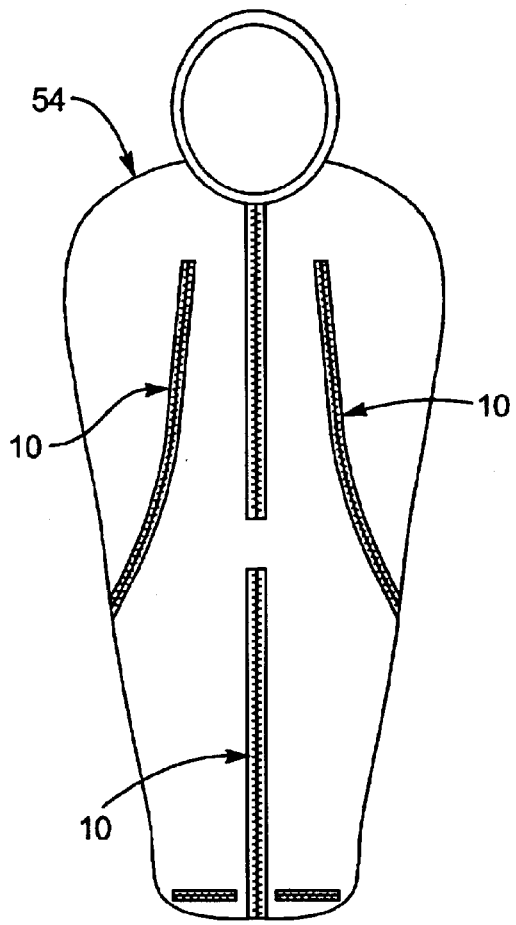
FIGS. 7A and 7B show embodiments of the present invention comprising a connect-release zipping device incorporated into a sleeping suit.
Figure 7B:
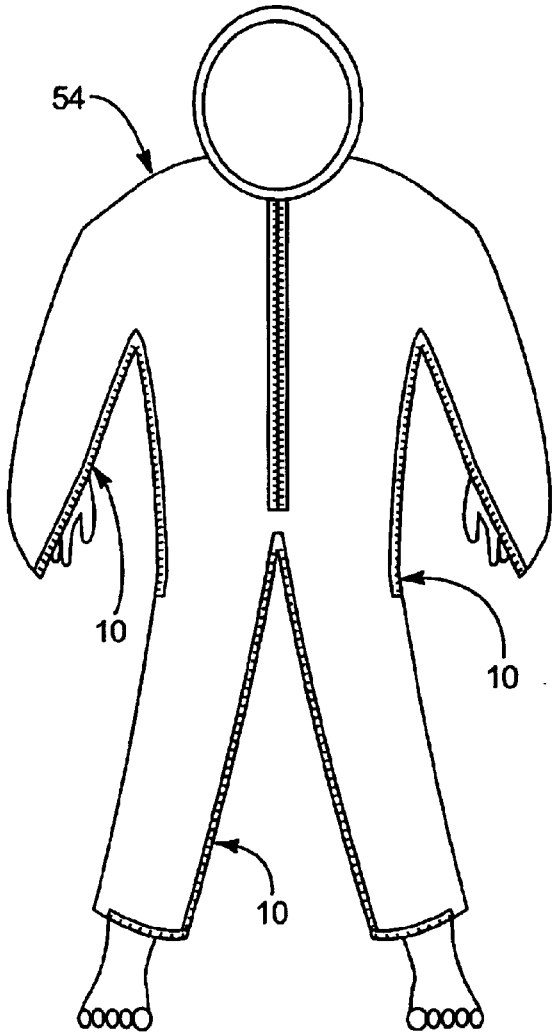

As illustrated in FIGS. 7A and 7B, the advantages of the quad zipper 10 of the present invention are particularly apparent when the quad zipper 10 is used to transform a sleeping bag into a jumpsuit. For example, FIGS. 7A and 7B show three quad zippers 10 incorporated into a specially designed sleeping bag/sleeping suit 54. In FIG. 7A, the quad zippers 10 are shown in a state wherein two opposing zipper tracks within each quad zipper 10 are zipped closed so that the sleeping bag/sleeping suit 54 is useful as a sleeping bag; of course, since the zipper sliders in the quad zippers 10 are in alternating orientations, the other two zipper tracks within each quad zipper 10 are in an unzipped state in FIG. 7A.

In FIG. 7B, the quad zippers 10 that were closed in FIG. 7A are now open; those that were open in FIG. 7A are now closed. As a result, the sleeping bag/sleeping suit 54 is now useful as a jumpsuit. In other words, with one simple push or pull on a quad zipper 10, an occupant of the sleeping bag/suit 54 can quickly and easily transform the bag/suit 54 from a sleeping bag to a jumpsuit (and vice versa) without having to exit the bag/suit 54 and expose himself or herself to freezing temperatures. Draft tubes may additionally be placed inside the bag/suit 54 to block the exterior air from coming through the zipper tracks.

It should be noted that a simpler bag/suit 54 could be made by excluding the two quad zippers 10 at the arms so that the quad zipper 10 at the crotch is the only quad zipper 10 in the bag/suit 54. In addition, any number of standard zippers (such as the un-numbered zippers shown in FIGS. 7A and 7B) may be incorporated into the bag/suit 54 in addition to the quad zippers 10.

The ability of the quad zipper 10 to, when exerted upon by one simple pushing or pulling motion, connect two edges of fabric while simultaneously disconnecting another two edges of fabric can be useful in other contexts outside of sleeping bag/suits. For example, the quad zipper 10 can be used to create different compartments in a backpack or for transforming a purse into different sizes or volumes.

It should be emphasized that the present invention is not limited to the examples described in this Detailed Description. For example, the quad zipper 10, also herein called a "connect-release zipping device," may include multiple zipper tracks of a number other than four. As another example, the handle on the central connector 16 may comprise a surface on the central connector 16 or may be an additional piece attached to the central connector 16. In addition, the central connector 16 and zipper sliders may be all part of one specially-made part—instead of being parts that are initially separate and then coupled together. The central connector, the zipper sliders, the zipper tracks, the handle, and the various other parts of the present invention all may be made of any material and be made into any shape that will accomplish the functions of the present invention.

It is underscored that the present invention may be embodied in other specific forms without departing from its spirit or essential characteristics. The described embodiments herein should be deemed only as illustrative. Indeed, the appended claims indicate the scope of the invention; the description, being used for illustrative purposes, does not limit the scope of the invention. All variations that come within the meaning and range of equivalency of the claims are to be embraced within their scope.

What is claimed is:

1. A system comprising:

at least four zipper tracks;

at least four zipper sliders, one on each of said zipper tracks; and a central connector to which said zipper sliders are affixed in such a way that when one of said zipper sliders moves along its respective zipper track, all of the other zipper sliders simultaneously move along their respective zipper tracks.

2. The system of claim 1 wherein the zipper sliders are affixed to the central connector so that they zip in alternating directions.

3. The system of claim 1 wherein the zipper sliders are affixed to the central connector in a ring-like formation.

4. The system of claim 1 wherein the zipper sliders further comprises holes, and the central connector comprises two pieces that snap together, thereby securing the zipper sliders to the central connector through said holes in the zipper sliders.

5. The system of claim 1 wherein the central connector and the zipper sliders are coupled together to form one piece via insert molding.

6. The system of claim 1 wherein the central connector comprises:

a center post to which the zipper sliders are affixed; and side walls for supporting said zipper sliders against said center post and for serving as surfaces whereby a user can push and pull said central connector along the zipper tracks.

7. The system of claim 1 wherein the central connector and the zipper sliders comprise an integrally formed piece formed from a single mould.

8. The system of claim 1 wherein the central connector further comprises a handle suitable for both pushing and pulling the central connector along the zipper tracks.

9. The system of claim 8 wherein said handle is shaped like a milk bottle.

10. The system of claim 8 wherein said handle is integrally formed with said central connector, said handle comprising a first side, a second side, and a bottom surface, said first and second sides being designed to be grasped by a thumb and forefinger, and said bottom surface being designed to be pushed up on from below.

11. The system of claim 1 wherein said zipper tracks are attached to a sleeping bag so that the bag can be transformed into a jumpsuit.

12. The system of claim 1 wherein said zipper tracks are incorporated into material so that the material can be compartmentalized into alternative volumes.

13. A system comprising:

a multiple number of zipper tracks;

a zipper slider on each of said zipper tracks; and a central connector to which said zipper sliders are affixed in such a way that when one of said zipper sliders moves along its respective zipper track, all of the other zipper sliders simultaneously move along their respective zipper tracks, said zipper sliders being fixed to said central connector in a ring-like formation.

14. The system of claim 13 wherein each zipper slider is affixed to the central connector so that the zipper sliders zip in alternating directions.

15. The system of claim 13 wherein said zipper tracks are attached to a sleeping bag so that the bag can be transformed into a jumpsuit.

16. The system of claim 15 further comprising draft tubes coupled to the inside of said sleeping bag to prevent exterior air from entering through the zipper tracks.

17. A system comprising:

four zipper tracks sewn together in a ring-like formation, said zipper tracks also being sewn into a sleeping bag to form an inseam that divides said sleeping bag into two volumes suitable for separately encasing the legs of an occupant of the sleeping bag;

a zipper slider on each of said zipper tracks;

a central connector to which said zipper sliders are affixed in such a way that when one of said zipper sliders moves along its respective zipper track, all of the other zipper sliders simultaneously move along their respective zipper tracks; and a handle suitable for both pushing and pulling the central connector along the zipper tracks.

18. The system of claim 17 wherein two of said zipper tracks are designed to zip together simultaneously as the other two of said zipper tracks unzip.

19. The system of claim 18 wherein the tracks that zip together are located opposite one another, and the tracks that unzip are located opposite one another.

20. The system of claim 17 further comprising material attached to said zipper tracks, said material being compartmentalized into alternative volumes when said handle is moved along the zipper tracks.

* * * * *